US009776148B2

(12) United States Patent
Xu et al.

(10) Patent No.: US 9,776,148 B2
(45) Date of Patent: Oct. 3, 2017

(54) BLADE DEVICE FOR A MIXING PROPELLER AND THE APPLICATION THEREOF

(71) Applicant: JIANGSU PROVINCIAL ACADEMY OF ENVIRONMENTAL SCIENCE, Nanjing, Jiangsu (CN)

(72) Inventors: Ming Xu, Jiangsu (CN); Weijing Liu, Jiangsu (CN); Yong Tu, Jiangsu (CN); Haisuo Wu, Jiangsu (CN)

(73) Assignee: JIANGSU PROVINCIAL ACADEMY OF ENVIRONMENTAL SCIENCE, Nanjing, Jiangsu (CN)

( * ) Notice: Subject to any disclaimer, the term of this patent is extended or adjusted under 35 U.S.C. 154(b) by 307 days.

(21) Appl. No.: 14/605,128

(22) Filed: Jan. 26, 2015

(65) Prior Publication Data

US 2016/0067658 A1 Mar. 10, 2016

(30) Foreign Application Priority Data

Nov. 29, 2013 (CN) ..... 2013 1 0620918

(51) Int. Cl.
*B01F 11/00* (2006.01)

(52) U.S. Cl.
CPC ..... *B01F 11/0091* (2013.01); *B01F 11/0088* (2013.01); *B01F 2215/0052* (2013.01)

(58) Field of Classification Search
CPC ..... B01F 11/0091; B01F 11/0088; B01F 2215/0052; B01F 7/00341; F04D 7/04; F04D 7/045; F04D 13/08; F04D 13/086; F04D 33/00; F04D 35/00
USPC ..... 416/100, 175, 198 R
See application file for complete search history.

(56) References Cited

U.S. PATENT DOCUMENTS 3,847,109 A * 11/1974 Hillman ..... B63H 1/08 416/112
4,548,765 A * 10/1985 Hultholm ..... B01F 7/00466 209/169
5,246,289 A * 9/1993 Middleton ..... B01F 3/04531 261/93

(Continued)

FOREIGN PATENT DOCUMENTS

CN 203155141 U 8/2013

OTHER PUBLICATIONS

Klaff, Nancee,. Isosceles Trapezoids. Auburn University, [retrieved on Jan. 17, 2017]. Retrieved from the Internet <URL: http://http://www.auburn.edu/~klaffnr/writeup3/isoscelestrapezoidexamples.html>.*

*Primary Examiner* — Woody Lee, Jr.
*Assistant Examiner* — Eric Zamora Alvarez
(74) *Attorney, Agent, or Firm* — Novick, Kim & Lee, PLLC; Allen Xue

(57) ABSTRACT

A blade device for a mixing propeller has a rocking shaft and a plurality of blade units. The blade unit is made of a flexible material and is installed on the rocking shaft via a fixing groove. The blade unit includes a horizontal propelling flexible blade and a vertical uplifting flexible blade. The fixing groove has a horizontal section and a vertical section. One end of the horizontal propelling flexible blade is inserted in the vertical section of the fixing groove while the other end of which is kept free so that it can swing back and forth. One end of the vertical uplifting flexible blade is inserted in the horizontal section of the fixing groove while the other end of which is kept free so that it can swing back and forth.

6 Claims, 5 Drawing Sheets

(56) References Cited

U.S. PATENT DOCUMENTS

Figure 1:
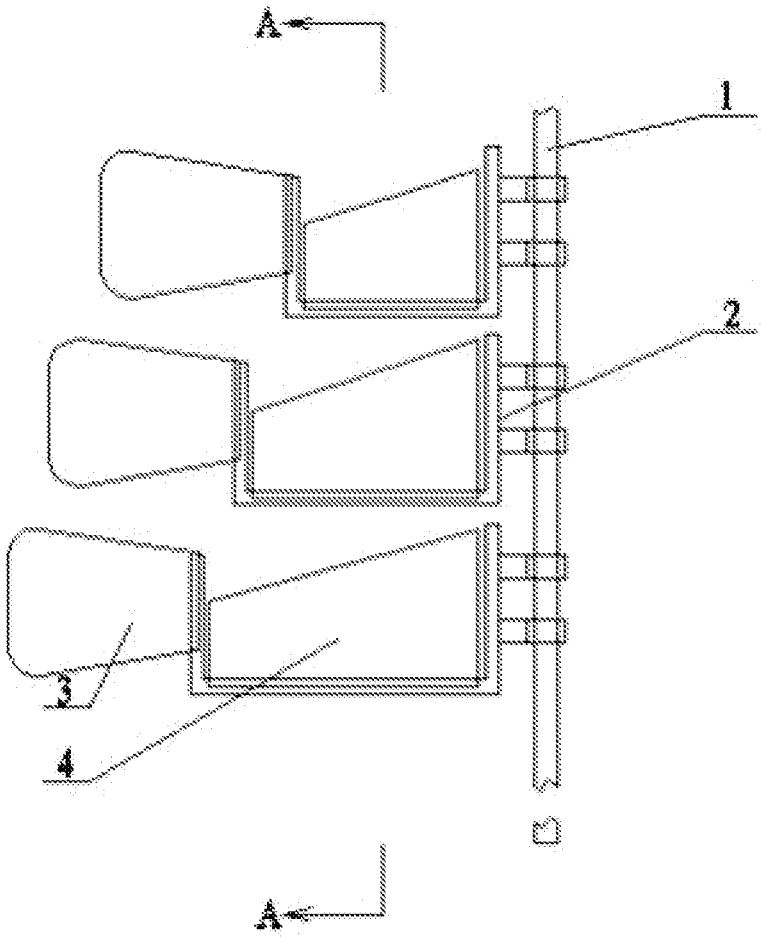

| | | | | |
|---|---|---|---|---|
| 5,993,158 | A * | 11/1999 | Young | A47J 43/1068<br>416/132 A |
| 6,334,705 | B1 * | 1/2002 | Weetman | B01F 7/00341<br>366/330.1 |
| 6,877,959 | B2 * | 4/2005 | McWhirter | F04D 29/384<br>366/265 |
| 7,401,974 | B2 * | 7/2008 | Himmelsbach | B01F 7/00341<br>366/330.3 |
| 8,146,895 | B2 * | 4/2012 | Hills | B01F 3/04595<br>261/87 |
| 2011/0211418 | A1 * | 9/2011 | Tassone | B01F 3/18<br>366/8 |

* cited by examiner

BLADE DEVICE FOR A MIXING PROPELLER AND THE APPLICATION THEREOF

THE FIELD OF THE INVENTION

The present invention relates to devices for wastewater treatment, specifically to a blade device and its application in a mixing propeller that is used for treating the low-speed liquid mixture.

TECHNICAL BACKGROUND

Currently, in the field of wastewater treatment, submersible mixers are widely utilized in both China and most of other countries for industrialized-scale treatment of liquid mixture. The blades designed for these submersible mixers are all made of rigid material. As drive motors of these submersible mixers were installed below the liquid surface, the designing and manufacturing processes of these mixers require sophisticated techniques. Besides, once being manufactured out, these mixers are usually considerably huge. As to those experimental-use small mixers, like those designed out of the same principles for industrialized production, they also present a variety of shortcomings such as inconvenience for being placed in the channel of a biopool, inducing undesirable flow states, high manufacturing cost, vulnerability to damage and difficulty for maintenance. Therefore, they are not suitable for being used in the wastewater treatment that requires long operational duration and high stability.

With increasing demand in municipal sewage treatment and increasingly strict standards on effluent discharge, more and more efforts, financially and scientifically, have been taken to realize up-standard discharge of municipal sewage. Therefore, the research and development of small-sized, high-efficient devices for wastewater treatment are of great market potential.

Chinese Patent CN 2031551410 (date of authorization: 2013 Aug. 28) disclosed a blade device used on a precipitated-silica pulping machine. The blade device comprises two mutually symmetric components that are bolted on the main shaft via a connecting plate. Each component bears two identical blade units that are 90-degree connected to each other through a base plate, and four blade units of the two components constitute the whole blade-containing mixing system. Each blade unit consists of a horizontal blade and a vertical blade, and both the horizontal and vertical blades are in serrated form. When being adopted for pulping precipitated silica, this blade device presents some advantages such as good shearing effect, short pulping time and low energy consumption. However, it has some disadvantages as well. For example, both horizontal and vertical blades of the blade device are installed at fixed places and are made of rigid material, which make the whole blade device, apart from desirable shearing force and mixing effect, generates no forward-going and uplifting force. Therefore, the blade device disclosed in this cited invention shows poor effect in propelling the liquid mixture upward.

SUMMARY OF THE INVENTION

1. The Problems to be Solved

The present invention discloses a blade device for a mixing propeller and its application so that the shortcomings, such as high technical demand in manufacturing process, big body volume and undesirable quick flow rate presented in the prior art can be effectively overcome. This blade device can circuitously propel and uplift the liquid mixture at the same time, which consequently extends the retention time of the sewage in the biopool and prevents precipitation of activated sludge flocs. It also enjoys such advantages as being simple in structure, stable during operation and easy for maintenance.

2. Technical Solutions

The following technical solutions are adopted to materialize the objective of the present invention.

A blade device for a mixing propeller has a rocking shaft and a plurality of blade units, the blade units are made of flexible material and are installed on the rocking shaft by means of the fixing groove;

the flexible blade unit consists of a horizontal propelling flexible blade and a vertical uplifting flexible blade, and the fixing groove consists of a horizontal section and a vertical section; one end of the horizontal propelling flexible blade is inserted in the vertical section of the fixing groove while the other end of which is kept free so that it can swing back and forth; one end of the vertical uplifting flexible blade is inserted in the horizontal section of the fixing groove while the other end of which is kept free so that it can swing back and forth.

Preferably, the horizontal propelling flexible blade is in the form of an isosceles trapezoid, with a longer free end and a short fixed end; the vertical uplifting flexible blade is also in the form of a trapezoid whereof the angle between the free end and the fixed end is an acute one.

Preferably, the horizontal propelling flexible blade and the vertical uplifting flexible blade constitute a blade unit; there are a plurality of blade units evenly secured along the long axis of the rocking shaft; the deeper down from the liquid surface, the bigger the size of blade units is.

The application of a blade device for the mixing propeller, wherein the blade device for the mixing propeller is applied to propel and mix the liquid mixture at the flow rate lower than 0.25 m/s.

3. Beneficial Effects

In contrast with the prior art, the beneficial effects of the technical solutions disclosed in the present invention include:

(1) Unlike the screw propeller adopted in the prior art, which relies on the relative movement between the shaft and the drive motor, a design consequently leads to such problems as mechanical abrasion, liquid leakage and corrosion, the blade device disclosed in the present invention, due to the fact that all the components below the liquid surface are completely fixed, demonstrates many advantages such as being convenient for anticorrosive processing, simple in structure, stable during operation, easy for maintenance and low in manufacture cost;

(2) the horizontal propelling flexible blade exerts forward-going propelling effect to the liquid mixture due to the fact that one end of the horizontal propelling flexible blade is inserted in the vertical section of the fixing groove and the other end of which is kept free so that it can swing back and forth; meanwhile the vertical uplifting flexible blade exerts uplifting effect to the liquid mixture due to the fact that one end of the vertical uplifting flexible blade is inserted in the horizontal section of the fixing groove and the other end of which is kept free so that it can swing back and forth; such a design enables the blade device to present both propelling and uplifting functions to the liquid mixture; working under the low flow rate, the blade device disclosed in the present invention can effectively prevent precipitation of activated sludge flocs in the biopool; it is particularly suitable for realizing desirable flow state of the liquid mixture within small-sized channels.

(3) the horizontal propelling flexible blade disclosed in the present invention is in the form of an isosceles trapezoid, with a longer free end and a short fixed end; as the linear speed at the fixed end is slow whereas that at the free end is quick, the best propelling effect can be realized with the limited size of the flexible blade;

the vertical uplifting flexible blade is also in the form of a trapezoid whereof the angle between the free end and the fixed end is an acute one; as the linear speed increases proportionally with the increase of the distance away from the rocking shaft, the decrease of the impact size of the flexible blade can effectively keep the flexible blade in a desirable bending state, which consequently presents a desirable uplifting effect;

(4) the activated sludge flocs tend to precipitate, however, the plurality of blade units of the device disclosed in the present invention can provide not only continuous uplifting force for the flocs, but also forward-going propelling force at the cross section of the channel; meanwhile, the comparatively larger size of the flexible blade that is deeper down from the liquid surface can effectively prevent precipitation of flocs at the bottom of the biopool;

(5) in order to prevent precipitation of activated sludge flocs, the flow rate of the liquid mixture shall be kept at 0.25 m/s or above; however, a lower flow rate can increase the hydraulic retention time of the sewage in the channel, which consequently improves the removal efficiency of pollutants; the blade device for the mixing propeller disclosed in the present invention provides a desirable solution for realizing effective propelling and mixing functions (therefore preventing precipitation of flocs) at the flow rate lower than 0.25 m/s ("Specification for Design of Oxidation Ditch" compiled by the China Association for Engineering Construction Standardization stipulates that the flow rate of the liquid in the oxidation ditch shall not be lower than 0.25 m/s.)

BRIEF DESCRIPTION OF THE ATTACHED DRAWINGS

Figure 2:
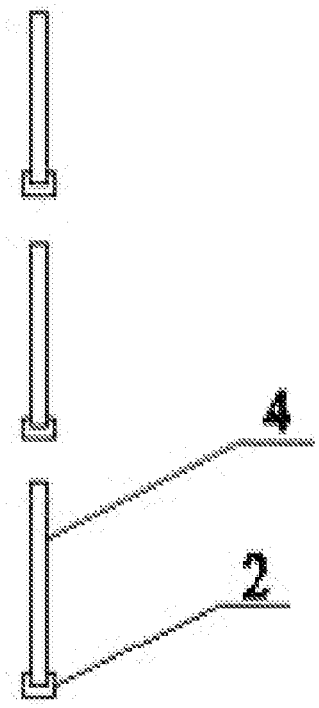
Figure 3:
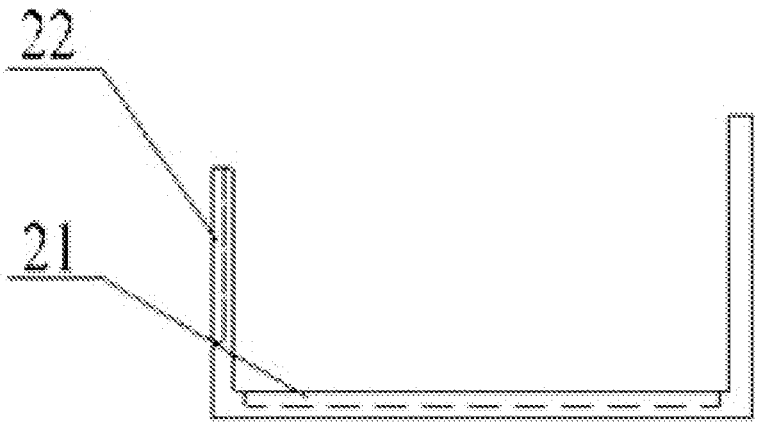
Figure 4:
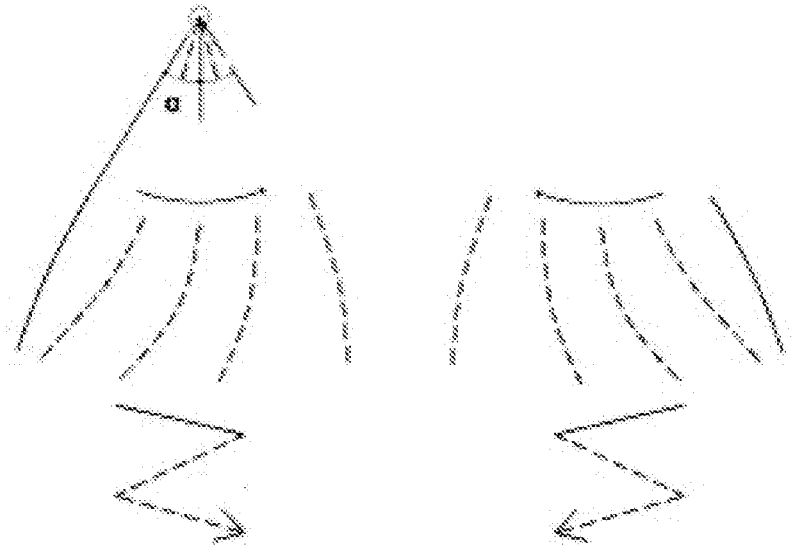
Figure 5:
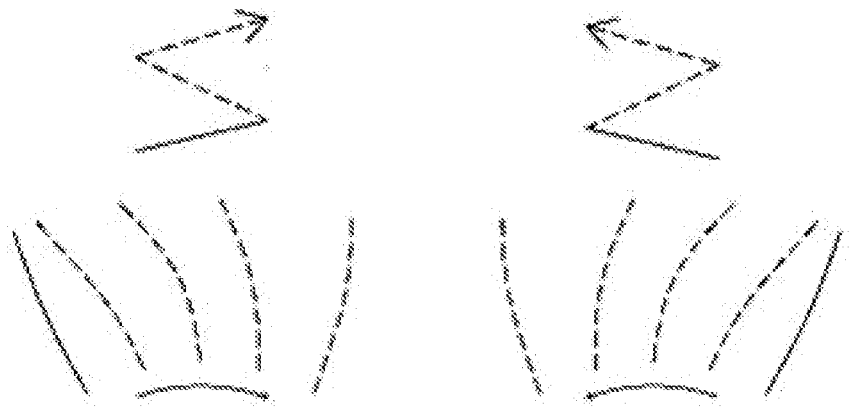

FIG. 1 structure diagram of the blade device disclosed in the present invention;

FIG. 2 sectional view of the blade device along the A-A axis indicated in FIG. 1;

FIG. 3 structure diagram of the fixing groove disclosed in the present invention;

FIG. 4 principle diagram of the flow state of the liquid mixture generated by the horizontal propelling flexible blade;

FIG. 5 principle diagram of the flow state of the liquid mixture generated by the vertical uplifting flexible blade.

In the drawings: 1. rocking shaft; 2. fixing groove; 21. horizontal section of the fixing groove; 22. vertical section of the fixing groove; 3. horizontal propelling flexible blade; 4. vertical lifting flexible blade.

SPECIFIC EMBODIMENTS

The present invention is further described in more detail in the following specific embodiments with reference to "Attached Drawings of the Description".

Embodiment 1

As is shown in FIG. 1 and FIG. 2, the blade device for the low-speed mixing propeller comprises a rocking shaft 1 and three fixing grooves 2 secured on the rocking shaft 1. As is shown in FIG. 3, each fixing groove 2 consists of a horizontal section 21 and a vertical section 22. One end of the horizontal propelling flexible blade 3 is inserted in the vertical section 22 of the fixing groove 2, and the other end of the horizontal propelling flexible blade 3 can swing back and forth; one end of the vertical uplifting flexible blade 4 is inserted in the horizontal section 21 of the fixing groove 2, and the other end of the vertical uplifting flexible blade 4 can swing back and forth. During the operation, the horizontal propelling flexible blade 3 can propel the liquid mixture to the pre-set flow rate while the vertical uplifting flexible blade 4 can uplift the liquid mixture so that the activated sludge flocs contained in the liquid mixture are brought upward, which consequently prevents undesirable precipitation of activated sludge flocs in the biopool.

As is shown in FIG. 1, both the horizontal propelling flexible blade 3 and the vertical uplifting flexible blade 4 are designed in a certain form. In accordance with a variety of flow states, the horizontal propelling flexible blade 3 and the vertical uplifting flexible blade 4 can be designed into different forms. In the present embodiment, the horizontal propelling flexible blade 3 is in the form of an isosceles trapezoid, with a longer free end and a shorter fixed end; the vertical uplifting flexible blade 4 is in the form of a right trapezoid whereof the angle between the free end and the fixed end is adjusted to 45°.

As is shown in FIG. 1, the blade device for the low-speed mixing propeller comprises three blade units evenly secured along the long axis of the rocking shaft 1; the size of the three blade units turns increasingly large as they go deeper down from the liquid surface. As the precipitation rate of the activated sludge flocs near the bottom is generally quicker than that near the surface, the size of the vertical uplifting part flexible blade 4 at the lower level is 10% bigger than that at its adjacent place; however, the size of the three horizontal propelling flexible blades 3 is the same. The blade device designed in this way can reach the best mixing effect as the sludge is effectively dispersed and almost no precipitation of flocs can be found.

Place the blade device into the activated sludge channel of a biopool. As is shown in FIG. 4, during the operation, the movement of the blade device leads to bending deformation of the horizontal propelling flexible blade 3 due to the existence of water resistance; the bending deformation of the horizontal propelling flexible blade can then propel the liquid mixture forward diagonally; as a result, the liquid mixture moves forward circuitously as it is repeatedly bounced back by channel walls; this pattern of movement increases the moving distance of the liquid mixture within the channel and consequently extends the retention time of the sewage therein; as is shown in FIG. 5, during the operation, the movement of the blade device also leads to bending deformation of the vertical uplifting flexible blade 4 due to the existence of water resistance; the bending deformation of the vertical uplifting flexible blade can then uplift the liquid mixture; as a result, the activated sludge flocs contained in the liquid mixture are brought upward as well, which effectively prevents precipitation of the sludge and ensures its sufficient mixing with the sewage.

Control the flow rate of the liquid mixture in the biopool around 0.2 m/s; the right-left oscillation of the rocking shaft driven by a motor makes the horizontal propelling flexible blade swing back and forth, which consequently propels the liquid mixture forward diagonally and realizes circuitous movement of the liquid mixture within the channel due to the liquid mixture repeatedly being bounced back by channel walls; the oscillation of the rocking shaft also enables the vertical uplifting flexible blade to lift the liquid mixture upward, which prevents undesirable precipitation of activated sludge flocs. When being adopted in the anaerobic and anoxic zones of the activated sludge process, the rocking shaft is usually driven in the pattern of screw propelling. In a small wastewater treatment system used for pilot-scale test, floating pieces of dead sludge often appear in the liquid mixture due to its low flow rate, a compromise embodied in the design of most systems; however, the adoption of the blade device disclosed in the present invention can significantly decrease the floating pieces of dead sludge, and the denitrification efficiency of the whole process will increase at least 5%.

Embodiment 2

The swinging frequency of the blade device is slowed down so that the impact of lowering down the flow rate on the efficiency of denitrification can be verified. The experiment was conducted using the blade device disclosed in Embodiment 1 and the blade device was also placed in the activated sludge channel of a biopool as was done in Embodiment 1. Control the flow rate of the liquid mixture in the channel around 0.1 m/s, and increase the number of blade devices distributed in the channel accordingly; during the 2 months' experiment, no floating piece of dead sludge was found, besides, the experiment showed even better efficiency in denitrification (the efficiency of denitrification increased at least 10%). However, though the efficiency of pollutant removal will increase when the flow rate of the liquid mixture turns lower, the number of the blade devices distributed in the channel must be increased accordingly, which consequently increases the operational cost. Therefore, the flow rate of the liquid mixture shall not be controlled too low.

It should be understood that the above embodiments are merely to illustrate rather than to limit the present invention. By the same token, what is shown in the attached drawings is only one exemplary embodiment of the present invention, and the structure of the present invention in practical application is not limited to it. Accordingly, any modification or alteration made by the person skilled in the field without departing from the spirit and scope of this disclosure shall fall within the scope of the present invention.

What is claimed is:

1. A blade assembly, comprising:

a rocking shaft (1) installed in a vertical direction and a plurality of blade units, each of the plurality of blade units is affixed to the rocking shaft (1) through a fixing groove (2), and each of the plurality of blade units comprises a first flexible blade (3) and a second flexible blade (4), wherein the fixing groove (2) comprises a first vertical section (22), a second vertical section, and a horizontal section (21) connecting the first vertical section (22) and the second vertical section, the second vertical section is affixed to the rocking shaft (1), and wherein one end of the first flexible blade (3) is affixed to the first vertical section (22) and an opposite end of the first flexible blade (3) is not affixed and points away from the rocking shaft (1), and wherein one end of the second flexible blade (4) is affixed to the horizontal section (21) and an opposite end of the second flexible blade (4) is not affixed and points to the vertical direction.

2. The blade assembly of claim 1, wherein the first flexible blade (3) is substantially in a form of an isosceles trapezoid having a long edge and a short edge parallel to each other, wherein the short edge is affixed to the first vertical section (22), and wherein the second flexible blade (4) is substantially in a form of a right trapezoid, whereby an edge connecting two right angles in the right trapezoid is affixed to the horizontal section (21).

3. The blade assembly of claim 2, wherein sizes of two second flexible blades (4) in two adjacent blade units are different by about 10%.

4. The blade assembly of defined in claim 1, where first flexible blades (3) in the plurality of blade units are each identical in size, and second flexible blades (4) in the plurality of blade units each have a different size.

5. The blade assembly of claim 4, wherein the size of each of the second flexible blades (4) in the plurality of blade units arranged in the vertical direction continuously increases.

6. A method for propelling a liquid mixture, comprising:

placing the blade assembly of claim 1 in the liquid mixture;

oscillating the rocking shaft to cause the plurality of the blade units in the blade assembly to oscillate correspondingly in an angular direction, whereby causing the liquid mixture to flow at a rate lower than 0.25 m/s.

* * * * *